US010354782B2

(12) United States Patent
Zheng et al.

(10) Patent No.: US 10,354,782 B2
(45) Date of Patent: Jul. 16, 2019

(54) COMPOSITION FOR AND METHOD OF MAKING AN INSULATOR FOR A SPARK PLUG

(71) Applicant: Fram Group IP, LLC, Lake Forest, IL (US)

(72) Inventors: Jing Zheng, Findlay, OH (US); Danny R. Overton, West Millgrove, OH (US)

(73) Assignee: Fram Group IP, LLC, Lake Forest, IL (US)

( * ) Notice: Subject to any disclaimer, the term of this patent is extended or adjusted under 35 U.S.C. 154(b) by 982 days.

(21) Appl. No.: 14/601,359

(22) Filed: Jan. 21, 2015

(65) Prior Publication Data

US 2015/0228384 A1 Aug. 13, 2015

Related U.S. Application Data

(60) Provisional application No. 61/939,425, filed on Feb. 13, 2014.

(51) Int. Cl.

| | |
|---|---|
| ***H01B 19/00*** | (2006.01) |
| ***H01B 3/10*** | (2006.01) |
| ***H01T 13/38*** | (2006.01) |
| ***H01T 13/20*** | (2006.01) |
| ***H01T 21/02*** | (2006.01) |

(52) U.S. Cl.

CPC ..... *H01B 19/00* (2013.01); *H01B 3/10* (2013.01); *H01T 13/20* (2013.01); *H01T 13/38* (2013.01); *H01T 21/02* (2013.01); *Y10T 29/49227* (2015.01)

(58) Field of Classification Search

CPC .... Y10T 29/49227; H01T 13/20; H01B 19/00

See application file for complete search history.

(56) References Cited

U.S. PATENT DOCUMENTS

| | | | | |
|---|---|---|---|---|
| 3,088,832 | A * | 5/1963 | Somers | C04B 35/111 501/153 |
| 5,204,579 | A | 4/1993 | Oshima et al. | |
| 2001/0004184 | A1 | 6/2001 | Ito et al. | |
| 2002/0033659 | A1 | 3/2002 | Nishikawa et al. | |
| 2003/0122462 | A1 | 7/2003 | Nishikawa et al. | |

(Continued)

FOREIGN PATENT DOCUMENTS

| | | |
|---|---|---|
| CN | 1317857 | 10/2001 |
| CN | 102858713 | 1/2013 |

(Continued)

OTHER PUBLICATIONS

Office Action issued in related Chinese Application No. 201580008507.4 dated Mar. 21, 2017.

(Continued)

*Primary Examiner* — Joseph L Williams

(74) *Attorney, Agent, or Firm* — Miller Canfield

(57) ABSTRACT

A method of manufacturing an insulator for a spark plug comprises the steps of combining at least two raw materials to form a powdered insulator formulation, spray drying the powdered insulator formulation, and pressing the powdered insulator formulation to create an insulator blank. The method further includes the steps of bisque firing the insulator blank, grinding the bisque fired insulator blank to form the insulator, and sintering the insulator.

15 Claims, 6 Drawing Sheets

(56) References Cited

U.S. PATENT DOCUMENTS

| | | | | |
|---|---|---|---|---|
| 2010/0044929 | A1 | 2/2010 | Boehler | |
| 2011/0005485 | A1* | 1/2011 | Kurono | H01T 13/38 123/169 R |
| 2011/0077141 | A1 | 3/2011 | Walker et al. | |
| 2011/0248620 | A1 | 10/2011 | Shibata et al. | |

FOREIGN PATENT DOCUMENTS

| | | |
|---|---|---|
| JP | S6139387 | 2/1986 |
| JP | H0558711 | 3/1993 |
| JP | H09286669 | 11/1997 |
| JP | 2000-203949 | 7/2000 |
| JP | 2009231268 | 10/2009 |
| JP | 2009541940 | 11/2009 |
| JP | HEI2013119485 | 6/2013 |
| WO | 2011133741 | 10/2011 |

OTHER PUBLICATIONS

International Search Report & Written Opinion of PCT/US2015/012145 dated May 8, 2015.
Japanese Application No. 2016-550807 Office Action dated Jul. 30, 2018.
European Search Report of Application No. 15748514.5 dated Sep. 5, 2017.
Chinese Application No. 201580008507.4 Office Action dated Oct. 23, 2017.
Chinese Search Report of Application No. 201580008507.4 dated Oct. 23, 2017.
Chinese Application No. 201580008507.4 Office Action dated Apr. 3, 2018.
Chinese Search Report of Application No. 201580008507.4 dated Apr. 3, 2018.
Japanese Application No. 2016-550807 Office Action dated Dec. 5, 2018.

* cited by examiner

Surface of virgin wheel

Surface of loaded grinding wheel

| *temperature ( C )* | Control | 650 | 750 | 850 | 950 | 1050 | 1100 | 1200 |
|---|---|---|---|---|---|---|---|---|
| ***Green strength (lbs)*** | 3.7 | 4.5 | 5.3 | 13.2 | 21.6 | 18.8 | 22.2 | 36.1 |

| | Sample powder 1 | | | | Sample powder 2 | | | |
|---|---|---|---|---|---|---|---|---|
| | Control | @850C | @1050C, 20min | @1050C | Control | @850C | @1050C, 20min | @1050C |
| DE strength (Kv | 13.71 | 13.25 | 13.21 | 12.74 | 13.47 | 13.09 | 13.25 | 12.88 |
| COV | 1.63 | 1.28 | 3.142027603 | 4.82 | 1.72 | 3.83 | 3.83 | 5.20 |

COMPOSITION FOR AND METHOD OF MAKING AN INSULATOR FOR A SPARK PLUG

CROSS REFERENCE TO RELATED APPLICATIONS

This application claims the benefit under 35 U.S.C. § 119(e) of U.S. Provisional Patent Application Ser. No. 61/939,425 filed Feb. 13, 2014, the entire contents of which are hereby incorporated by reference.

BACKGROUND

1. Field of the Invention

Exemplary embodiments of the present invention relate to a spark plug or igniter for an internal combustion engine, and more particularly to compositions for and methods of making an insulator for a spark plug or igniter.

2. Description of the Background

As is illustrated in FIG. 1, a conventional spark plug 10 may include an annular metal casing or shell 12 having a cylindrical base 14 with external threads 16 formed thereon for threadable engagement in a cylinder head (not shown) of an internal combustion engine. The cylindrical base 14 of the spark plug shell 12 may have a generally flattened lower surface 18. A ground or side electrode 20, for example, of a noble metal, may be welded or otherwise attached to the lower surface 18 of the threaded base 14. An electrode tip 22 may be welded or otherwise attached to an end of the side electrode 20.

The spark plug 10 may further include a hollow ceramic insulator 24 disposed concentrically within the shell 12 and a center electrode 26 disposed concentrically within the insulator 24. The center electrode 26 may include a central core 28 that is made of a thermally and electrically conductive material and an outer cladding 30.

An electrically conductive insert or rod 36 fits into an upper end 38 of the insulator 24 opposite the center electrode 26 and a refractory glass-carbon composite material is disposed within the insulator 24 between a lower end 39 of the insert 36 and the center electrode 26 to provide an internal resistor 40 with the spark plug 10.

As illustrated in FIG. 1, the spark plug shell 12 is a substantially cylindrical sleeve having a hollow bore 42 formed therethrough. As noted above, the spark plug shell 12 includes the cylindrical base portion 14, which generally has threads 16 formed on the exterior surface thereof. The spark plug shell 12 may include a sealing surface 44 for contacting the cylinder head (not shown) and, on the spark plug shell 12 above the sealing surface 44, a generally hexagonal boss 46 for allowing the spark plug 10 to be grasped and turned by a conventional spark plug socket wrench for installation or removal thereof.

The insulator 24 is a ceramic article that has been conventionally manufactured, as depicted in FIG. 2, by collecting the raw materials necessary to form an insulator blank at block 102, preparing a raw material based powder by blending the appropriate percentages of each of the raw materials to create a desired powdered formulation at block 104, and spray drying the powdered formulation at block 106. A blank is thereafter formed by pressing the spray-dried powder at block 108, grinding or green machining the pressed blank on a grinding wheel to form an insulator preform at block 110, and firing or sintering the insulator preform to a high temperature sufficient to densify the preform and sinter the powder particles to form a finished insulator or chalk insulator at block 112. The insulator preform is generally fired at temperatures of up to between about 1400 and about 1600 degrees Celsius. A prior art sintering profile is depicted in FIG. 3, wherein a peak temperature of a little less than 1600 degrees Celsius is reached.

Following the trend of engine downsizing, spark plugs have become thinner and longer. In order to fit in the smaller package, the ceramic insulators of such spark plugs have been significantly reduced, leading to a reduction in maximum ignition voltage the spark plug can withstand. However, as the result of engine downsizing and the wider use of turbocharging, higher cylinder pressures are anticipated for future combustion engines, which require higher ignition voltages and higher operation temperature. These challenges have demanded that insulators of spark plugs for future combustion engine possess much higher dielectric strength than those used today.

SUMMARY OF THE INVENTION

In accordance with a non-limiting illustrative embodiment, a method of manufacturing an insulator for a spark plug may comprise the steps of combining at least two raw materials to form a powdered insulator composition or formulation, spray drying the powdered insulator formulation, and pressing the powdered insulator formulation to create an insulator blank. The method may further include the steps of bisque firing the insulator blank, grinding the bisque fired insulator blank to form the insulator, and sintering the insulator.

In illustrative embodiments, the bisque firing step may involve heating the powdered insulator to a peak temperature of between about 450 degrees Celsius and about 1200 degrees Celsius. In other illustrative embodiments, the bisque firing step involves heating the powered insulator to a peak temperature of between about 750 degrees Celsius and about 1000 degrees Celsius.

In illustrative embodiments, the sintering step may involve heating the insulator to a peak temperature of between about 1400 degrees Celsius and about 1700 degrees Celsius.

In illustrative embodiments, the powdered insulator formulation may comprise aluminum oxide and at least one binder, wherein during the bisque firing step, at least 60% of the binder is removed. In other illustrative embodiments, during the bisque firing step, all of the binder is removed.

In illustrative embodiments, an average diameter of the particles of the insulator blank may be less than or equal to about 2 microns.

In illustrative embodiments, the method may further include the step of fusing particles of the insulator blank during the bisque firing step.

In accordance with another non-limiting illustrative embodiment, a method of manufacturing an insulator for a spark plug may comprise the steps of combining at least aluminum oxide and at least one binder to form a powdered insulator formulation, wherein an average particle size for the powdered insulator formulation is less than or equal to about 2 microns and spray drying the powdered insulator formulation. The method may further include the steps of pressing the powdered insulator formulation to create an insulator blank, bisque firing the insulator blank to a peak temperature of between about 450 degrees Celsius and about 1200 degrees Celsius, grinding the bisque fired insulator blank to form the insulator, and sintering the insulator.

In illustrative embodiments, the bisque firing step may involve heating the powdered insulator to a peak temperature of between about 750 degrees Celsius and about 1000 degrees Celsius.

In illustrative embodiments, during the bisque firing step, at least 60% of the binder may be removed. In other illustrative embodiments, during the bisque firing step, all of the binder may be removed.

In illustrative embodiments, the sintering step may involve heating the insulator to a peak temperature of between about 1400 degrees Celsius and about 1700 degrees Celsius.

In illustrative embodiments, the method may further include the step of fusing particles of the insulator blank during the bisque firing step.

In a further non-limited illustrative embodiment, a spark plug may comprise aluminum oxide particles having a size of less than or equal to about 2 microns and a binder binding the aluminum oxide particles prior to formation of the insulator.

In illustrative embodiments the insulator comprises aluminum oxide particles having a size of less than or equal to about 2 microns and less than or equal to about 40% of the binder remains in the insulator after formation of the insulator.

BRIEF DESCRIPTION OF THE DRAWINGS

Other aspects and advantages of the present disclosure will become apparent upon consideration of the following detailed description, wherein similar structures have like or similar reference numerals.

DETAILED DESCRIPTION OF EXEMPLARY EMBODIMENTS

The present disclosure is directed to compositions or formulations for and methods of making an insulator for a spark plug. While the formulations and methods of the present disclosure may be embodied in many different forms, several specific embodiments are discussed herein with the understanding that the present disclosure is to be considered only as an exemplification of the principles of the disclosure, and it is not intended to limit the disclosure to the embodiments illustrated.

Figure 1:
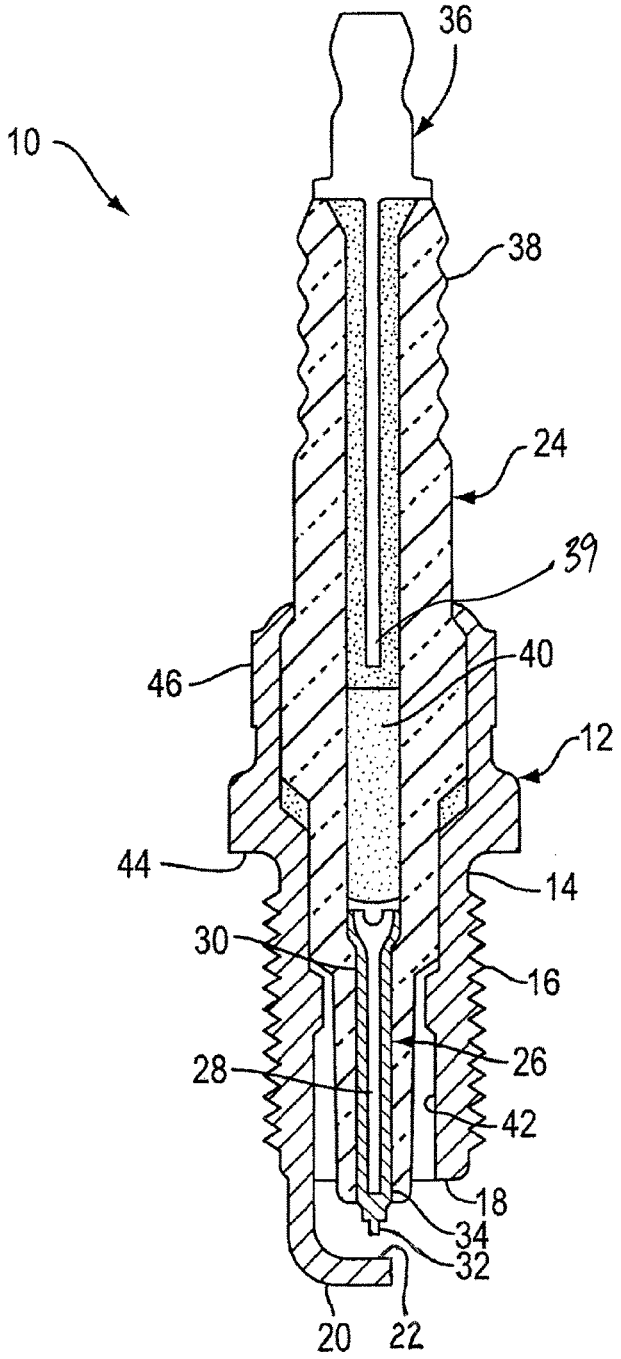
FIG. 1 PRIOR ART
FIG. 1 is a cross-sectional view of a prior art spark plug having an insulator that may be made using the method described with respect to FIG. 2.
Figure 2:
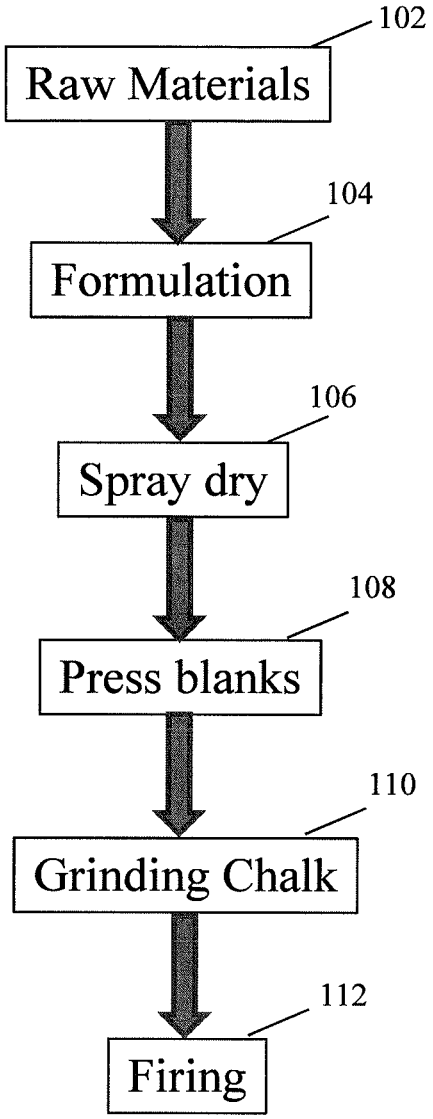
FIG. 2 PRIOR ART
FIG. 2 is a flow chart depicting a prior art method of making an insulator for a spark plug.
Figure 3:
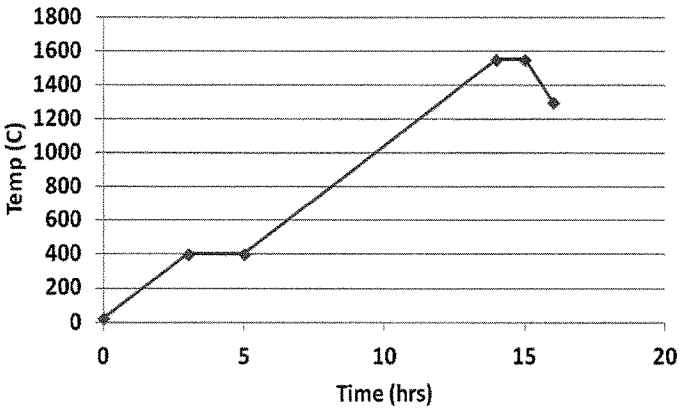
FIG. 3 PRIOR ART
FIG. 3 is an exemplary prior art sintering temperature profile.
Figure 4:
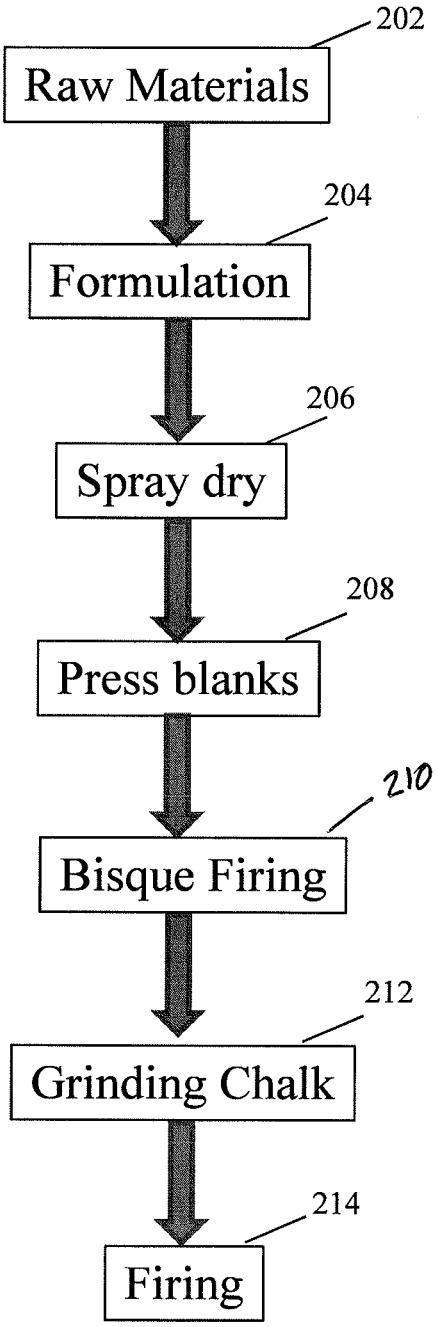
FIG. 4 is a flow chart depicting a method of the present disclosure for making an insulator for a spark plug.

Referring to FIG. 4, a method of the present disclosure for making an insulator for a spark plug 10 is depicted. The insulator may be the insulator 24 as described with respect to FIG. 1 or may be any other insulator for a spark plug. The method includes the steps of collecting the raw materials necessary to form an insulator at block 202, preparing a raw material based powder by blending the appropriate percentages of each of the raw materials to create a desired powdered formulation at block 204, and spray drying the powdered formulation at block 206. A blank is thereafter formed by pressing the spray-dried powder at block 208 and the pressed blank is thereafter bisque fired to a pre-sintered state at block 210. After the bisque firing step, the pressed and bisque fired blank is ground or green machined into a desired shape on a grinding wheel to form an insulator preform at block 212 and the insulator preform is fired to a peak temperature sufficient to densify the preform and sinter the powder particles to form a finished insulator or chalk insulator at block 214.

The raw materials used in block 202 of FIG. 4 may include aluminum oxide or alumina ($Al_2O_3$), water, one or more binders, and any other suitable components. In illustrative embodiments, the insulator may be fabricated from between about 85% by weight aluminum oxide and about 99.5% by weight aluminum oxide. In other illustrative embodiments, the insulator may be fabricated from between about 90% by weight aluminum oxide and about 97% by weight aluminum oxide. In still alternative illustrative embodiments, the insulator may be fabricated from about 95% by weight aluminum oxide. In illustrative embodiments, a final formulation of the insulator has an aluminum oxide content of between about 85% by weight aluminum oxide and about 99.5% aluminum oxide. In further illustrative embodiments, the final formulation of the insulator may have an aluminum oxide content of between about 90% by weight and about 97% by weight. In alternative illustrative embodiments, the final formulation of the insulator may have an aluminum oxide content of about 95% by weight. In still illustrative embodiments, the aluminum oxide content of the original formulation or the final formulation may be any suitable percentage by weight of the original and/or final formulation, respectively.

In illustrative embodiments, the raw materials may include one or more binders. The binders may be selected from the group of: polyvinyl alcohol (PVA), wax (paraffin and/or microcrystalline wax), Methocel™, polyethylene glycol (PEG), acrylic binder, and/or any other suitable binder. Any number of the same or different binders may be utilized. In illustrative embodiments, the original insulator formulation may be fabricated from between about 0.5% and about 4.0% by weight (in dry weight) binders. In other illustrative embodiments, the original insulator formulation may be fabricated from between about 1.5% and about 3.0% by weight (in dry weight) binders. In still other illustrative embodiments, the original insulator formulation may be fabricated from between about 2.0% and about 2.5% by weight (in dry weight) binders.

In order to attain higher dielectric strength, an alumina powder formulation having finer particles is used. The finer particles provide the sintered ceramic with a finer grain size and improved microstructures, which leads to significant increase in dielectric strength. In illustrative embodiments, an average diameter of the particles forming the pressed blank is, for example, between about 1 micron and about 3 microns. In other illustrative embodiments, the average diameter of the particles forming the pressed blank is between about 1.5 microns and about 2 microns, or about 1.5 microns. In still other illustrative embodiments, the average diameter of the particles forming the pressed blank is less than about 2 microns or less than about 1.5 microns. In comparison, typical particles forming a conventional pressed blank have an average diameter of between about 5 and about 6 microns.

The grinding step (block 212) of FIG. 4 is performed using a grinding wheel, which includes an abrasive surface coated with an abrasive material and including gaps or porosities between particles of abrasive material. During the grinding step (block 212) of FIG. 4, the smaller particles in the pressed and bisque fired blank, the partial sintering of the pressed blank, and the removal of at least some of the binder provide increased grindability, an increased strength, and reduced defects caused by grinding. More particularly, the partial sintering provides for stronger bonds between the particles that don't break down as easily during the harsh grinding process.

Because of the fine particle size, and hence a high surface area, compaction of the spray dried powder becomes a challenge. In order to obtain good compactions as well as maintain adequate green strength for downstream steps, higher organic binder is used in the formulations described herein. This had led to difficulty in grinding step, which is used to form the pressed blank into an insulator. During the grinding process, the particles removed from the pressed and bisque fired blank begin to fill the porosities within the surface of the grinding wheel. Smaller particles more readily fill the porosities within the surface of the grinding wheel, thereby necessitating frequent re-dressing of the grinding wheel (after, for example, grinding of 10 to 20 pieces). While re-dressing of the grinding wheel is still necessary after grinding the insulator blanks made from the methods disclosed herein, due to the increased strength of the pressed and bisque fired blanks, fewer particles are removed from the blank to fill the porosities, thereby requiring less frequent re-dressing (after, for example, grinding of 200 to 300 pieces).

As was seen, the main challenge with green machining of the pressed blank having fine particles is a decrease in the dressing interval of the grinding wheel, which is the time between necessary re-dressing of the grinding wheel. It was observed that, with the same binder system and the bisque firing step, the wheel dressing interval for pressed blanks with fine particles can be reduced to about one tenth of the dressing interval for pressed blanks with coarse particles. For example, as noted above, it has been observed that the grinding wheel must be re-dressed after grinding between about 20 to about 30 pressed blanks with fine particles. In contrast, the grinding wheel must be re-dressed after grinding between about 200 and 300 pressed blanks with coarse particles. The reduced dressing interval significantly reduces the productivity of making insulators with powder using fine particles and has previously created a technical hurdle to adopting fine grain ceramic in mass production of ceramic insulators.

Figure 5:
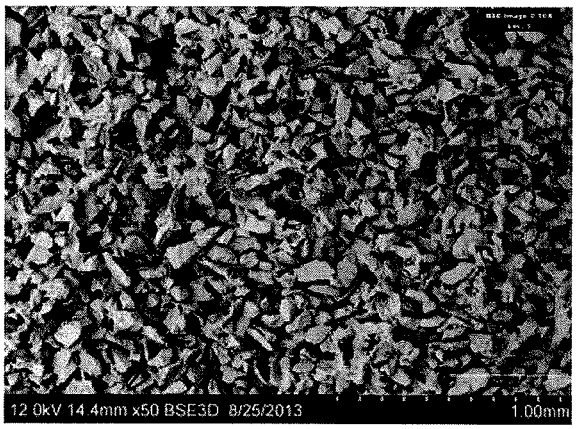
FIG. 5 depicts a virgin grinding wheel before grinding of insulator blanks.
Figure 6:
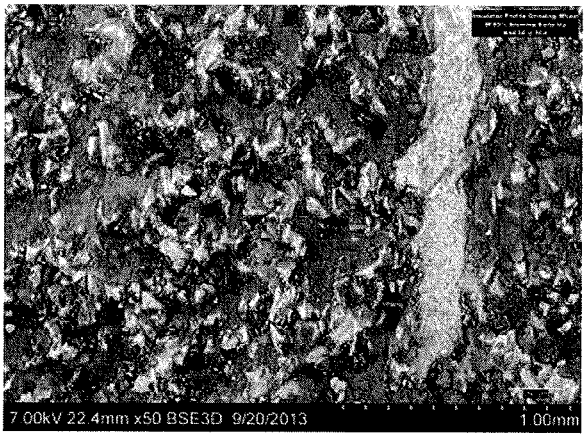
FIG. 6 depicts the grinding wheel of FIG. 5 after it is loaded with ceramic material from grinding of insulator blanks.

FIG. 5 depicts a virgin grinding wheel before grinding of insulator blanks therewith. FIG. 6 depicts the grinding wheel of FIG. 5 after it is loaded with ceramic material from the insulator blanks. As can be seen from FIG. 6, the surface of the loaded grinding wheel fills with particles that affect the grindability of the wheel and, thus, after a certain point, must be re-dressed such that the grinding wheel again looks and operates like the virgin wheel of FIG. 5.

The bisque firing step described in detail above increases the dressing interval of the grinding wheel for use with fine particles. In particular, during the bisque firing step, the organic binders are removed. In this manner, when the pressed and bisque fired blank is subjected to grinding, fewer of the particles from the grinding step are compacted into the porosity of the grinding wheel, thereby allowing the cutting edges to remain exposed for a longer period of time, and requiring less frequent re-dressing. Meanwhile, because of the loss of the organic binder materials, the firing temperature during the bisque firing step needs to be high enough to form a "necking" or fusing between alumina powders so that the pressed and bisque fired blank could have adequate binding strength to survive the harsh grinding step.

A peak temperature during the bisque firing step has to be high enough to remove the organic binder materials and accomplish a necking between the alumina particles to provide strength. Conversely, the peak temperature during the bisque firing step must be low enough to not cause sintering of the alumina powder, which could create an insulator blank that is too hard for the grinding process. In illustrative embodiments, depending on the size of the alumina powder and sintering aids (for example, clay materials) used, the peak bisque firing temperature may be between about 450 degrees Celsius and about 1200 degrees Celsius. In other illustrative embodiments, the peak bisque firing temperature may be between about 650 degrees Celsius and about 1100 degrees Celsius. In further illustrative embodiments, the peak bisque firing temperature may be between about 750 degrees Celsius and about 1000 degrees Celsius. In still further illustrative embodiments, the peak bisque firing temperature may be between about 750 degrees Celsius and about 850 degrees Celsius, or about 850 degrees Celsius.

Figure 7:
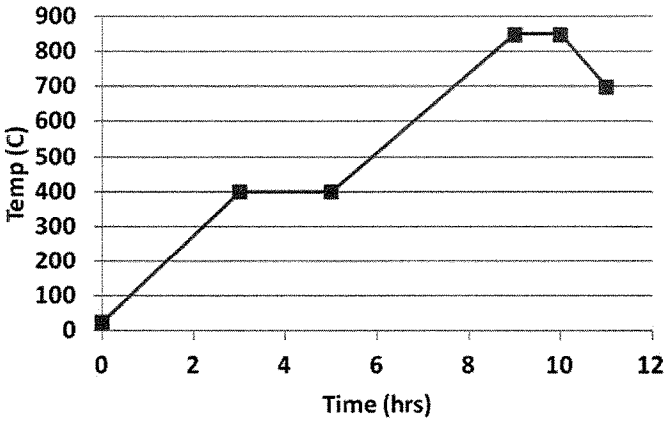
FIG. 7 depicts an exemplary bisque firing temperature profile.

An exemplary bisque firing temperature profile is depicted in FIG. 7, in which the temperature is increased over the first three hours from 0 degrees Celsius to about 400 degrees Celsius, the temperature is kept steady at about 400 degrees Celsius for about 2 hours, and the temperature is again increased for between about 3 and about 4 hours from 400 degrees Celsius to a peak temperature of about 850 degrees Celsius. The temperature is kept steady at about 850 for about 1 hour and the temperature is decreased to 700 degrees Celsius over a period of about 1 hour. The bisque firing may be accomplished in, for example, a batch oven, a tunnel kiln, or any other suitable device. Once the profile depicted in FIG. 7 is complete, the bisque fired blank is cooled to room temperature, for example, in the device used for bisque firing, before grinding.

While a particular bisque firing profile is depicted in FIG. 7, one skilled in the art will understand that other suitable bisque firing profiles are possible. The dwell times for retaining a steady temperature and the times for increasing and decreasing the temperature will vary dependent upon one or more temperatures used.

Figures 8, 9, 10:
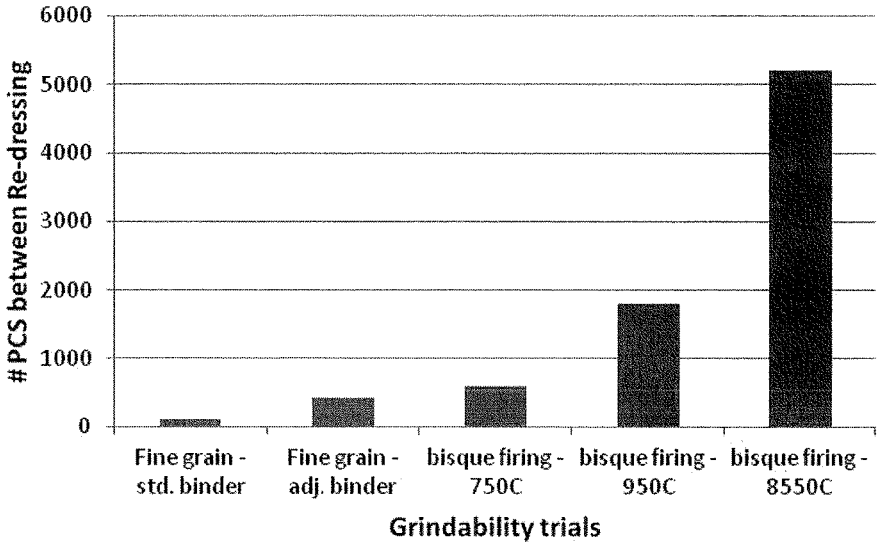
FIG. 8 depicts a bar chart comparing dressing interval (vertical axis) for insulator blanks with fine particles and no bisque firing and with bisque firing at various temperatures (horizontal axis)
FIG. 9 is a chart comparing green strength (in pounds) as a function of bisque firing temperature.
FIG. 10 is a chart depicting a dielectric strength and a density of pressed alumina blanks at various bisque firing temperatures.

FIG. 8 depicts a bar chart showing dressing intervals (vertical axis) for fine particles with no bisque firing and fine particles with bisque firing at various temperatures (horizontal axis). The fine particles with no bisque firing have dressing intervals of about 100 with a standard binder and about 400 with an adjusted binder and no bisque firing. Bisque firing temperatures of 750 degrees Celsius, 850 degrees Celsius, and 950 degrees Celsius lead to dressing intervals of about 600, 5000+, and about 1800, respectively. As noted above, the bisque firing temperature can be too high, such that the alumina powders sinter and become too hard for the grinding process. The results for 950 degrees Celsius show that higher temperatures begin to adversely affect the grindability of the insulator blanks, and thus, the dressing interval. The chart of FIG. 9 depicts the green strength (in pounds) for various bisque firing temperatures. The control provides a green strength comparison for a standard insulator with no bisque firing and coarse particles (5-6 microns). As can be seen from the chart of FIG. 9, peak bisque firing temperatures toward 650 degrees Celsius are closer to the control and peak bisque firing temperatures toward 1200 degrees Celsius are potentially too great and may pose a problem for grinding. The green strength for grinding may be between about 2.5 pounds and about 25 pounds. A more optimized range may be between about 3 pounds and about 15 pounds. As shown by FIG. 9, the green strength at about 950 degrees Celsius is outside the optimized range and, thus, as noted with respect to FIG. 8, begins to adversely affect grindability.

The testing of FIGS. 8-10 was conducted by forming the indicated insulators. The insulators referenced by "fine grain" in FIG. 8 and the insulators referenced by "control" in FIGS. 9 and 10 were not subjected to bisque firing. The remaining insulators were bisque fired according to the graph of FIG. 7, except that the peak temperature was varied.

To understand the impact of bisque firing on the performance of final sintered materials, samples were prepared at different peak bisque firing temperatures (see step 410 of FIG. 4) and followed by standard grinding and sintering (see steps 412 and 414 in FIG. 4). The chart of FIG. 10 depicts a dielectric strength and a density of pressed alumina blanks that are bisque fired at different temperatures. From the test data, it appears that too high of a peak temperature during bisque firing may potentially reduce the dielectric strength of the final insulator. This may be due to excessive growth of certain alumina grains.

The binder in the original insulator formulation may include between about 1 and about 2% by weight of one or more binders. As noted above, the temperature during the bisque firing step must be high enough to remove at least some, if not all, of the binder from the pressed blank. In illustrative embodiments, between about 60% and about 100% of the binder may be burnt out or removed from the pressed blank. In still further illustrative embodiments, between about 80% and about 100% of the binder may be burnt out or removed from the pressed blank. In an illustrative embodiment, 100% of the binder is removed during the bisque firing step. The bisque firing step also creates a partial sintering of the pressed blank, which fuses the particles together after removal of some or all of the binder from the pressed blank, thereby creating particle to particle necking or fusing.

The formulations and methods disclosed herein allow for use of fine particles in an insulator formulation to provide an insulator with a higher dielectric strength. More particularly, bisque firing of an insulator blank provides a pre-sintering step that removes at least a portion of a binder within the insulator blank and necks or fuses particles of the insulator blank together.

While the methods and formulations disclosed herein are described with respect to a particular spark plug (FIG. 1), the principles of the present disclosure, namely the methods and formulations disclosed herein, may be applied to any suitable spark plug. In particular, the insulators of the spark plugs disclosed in, for example, Below U.S. Pat. No. 8,350,456, Passman et al. U.S. Pat. No. 8,348,709, Below U.S. Pat. No. 8,568,181, Below et al. U.S. Pat. No. 8,035,286, Below U.S. Pat. No. 8,058,786, Below et al. U.S. Pat. No. 8,337,268, Below U.S. Pat. No. 8,030,831, Below U.S. Pat. No. 8,552,628, Unger et al. U.S. Pat. No. 8,558,439, Below U.S. Pat. No. 8,216,015, or Below U.S. Pat. No. 7,977,857, may be made by the methods disclosed herein and/or with the formulations disclosed herein. The disclosures of all of such patents are hereby incorporated by reference herein in their entireties.

Any of the embodiments described herein may be modified to include any of the structures or methodologies disclosed in connection with other embodiments.

Further, although directional terminology, such as front, back, top, bottom, upper, lower, etc. may be used throughout the present specification, it should be understood that such terms are not limiting and are only utilized herein to convey the orientation of different elements with respect to one another.

Numerous modifications to the present disclosure will be apparent to those skilled in the art in view of the foregoing description. Accordingly, this description is to be construed as illustrative only and is presented for the purpose of enabling those skilled in the art to make and use the embodiments of the disclosure and to teach the best mode of carrying out same. The exclusive rights to all modifications which come within the scope of the appended claims are reserved.

We claim:

1. A method of manufacturing an insulator for a spark plug, the method comprising the steps of:

combining at least two raw materials to form a powdered insulator formulation;

spray drying the powdered insulator formulation;

pressing the powdered insulator formulation to create an insulator blank;

bisque firing the insulator blank;

grinding the bisque fired insulator blank to form the insulator; and sintering the insulator, wherein the powdered insulator formulation comprises aluminum oxide and at least one binder, wherein during the bisque firing step, at least 60% of the binder is removed.

2. The method of manufacturing of claim 1, wherein the bisque firing step involves heating the powdered insulator to a peak temperature of between about 450 degrees Celsius and about 1200 degrees Celsius.

3. The method of manufacturing of claim 2, wherein the bisque firing step involves heating the powered insulator to a peak temperature of between about 750 degrees Celsius and about 1000 degrees Celsius.

4. The method of manufacturing of claim 3, wherein the sintering step involves heating the insulator to a peak temperature of between about 1400 degrees Celsius and about 1700 degrees Celsius.

5. The method of manufacturing of claim 1, wherein during the bisque firing step, all of the binder is removed.

6. The method of manufacturing of claim 1, wherein an average size of particles of the insulator blank is less than or equal to about 2 microns.

7. The method of manufacturing of claim 1, further including the step of fusing particles of the insulator blank during the bisque firing step.

8. The method of manufacturing of claim 1, wherein the sintering step involves heating the insulator to a peak temperature of between about 1400 degrees Celsius and about 1700 degrees Celsius.

9. The method of manufacturing of claim 1, wherein the at least two raw materials include aluminum oxide and at least one binder.

10. A method of manufacturing an insulator for a spark plug, the method comprising the steps of:

combining at least aluminum oxide and at least one binder to form a powdered insulator formulation, wherein an average particle size for the powdered insulator formulation is less than or equal to about 2 microns;

spray drying the powdered insulator formulation;

pressing the powdered insulator formulation to create an insulator blank;

bisque firing the insulator blank to a peak temperature of between about 450 degrees Celsius and about 1200 degrees Celsius;

grinding the bisque fired insulator blank to form the insulator; and sintering the insulator, wherein during the bisque firing step, at least 60% of the binder is removed.

11. The method of manufacturing of claim 10, wherein the bisque firing step involves heating the powdered insulator to a peak temperature of between about 750 degrees Celsius and about 1000 degrees Celsius.

12. The method of manufacturing of claim 10, wherein during the bisque firing step, all of the binder is removed.

13. The method of manufacturing of claim 10, wherein the sintering step involves heating the insulator to a peak temperature of between about 1400 degrees Celsius and about 1700 degrees Celsius.

14. The method of manufacturing of claim 10, further including the step of fusing particles of the insulator blank during the bisque firing step.

15. A spark plug, comprising:

an insulator comprising aluminum oxide particles having a size of less than or equal to about 2 microns and a binder binding the aluminum oxide particles, wherein the binder is combined with the aluminum oxide particles prior to formation of an insulator blank, wherein the insulator blank is bisque fired prior to formation of the insulator, such that at least a portion of the binder is removed, and wherein less than or equal to about 40% of the binder remains in the insulator after formation of the insulator.

* * * * *